US007193372B2

(12) United States Patent
Garavini et al.

(10) Patent No.: US 7,193,372 B2
(45) Date of Patent: Mar. 20, 2007

(54) ELECTRONIC BALLAST WITH VOLTAGE CONVERTER HAVING IMPROVED DAMPING ARRANGEMENT

(75) Inventors: Elisa Garavini, Munich (DE); Josef Osterried, Ottobrunn (DE)

(73) Assignee: Patent-Treuhand-Gesellschaft fur Elektrisch Gluhlampen mbH (DE)

( * ) Notice: Subject to any disclaimer, the term of this patent is extended or adjusted under 35 U.S.C. 154(b) by 65 days.

(21) Appl. No.: 11/121,066

(22) Filed: May 4, 2005

(65) Prior Publication Data

US 2005/0248293 A1 Nov. 10, 2005

(30) Foreign Application Priority Data

May 7, 2004 (DE) ..... 10 2004 022 571

(51) Int. Cl.
*H05B 41/16* (2006.01)

(52) U.S. Cl. ..... 315/247; 315/246; 315/209 R; 315/274; 315/279

(58) Field of Classification Search ..... 315/247, 315/246, 209 R, 224, 213, 274, 276, 279, 315/282, 287
See application file for complete search history.

(56) References Cited

U.S. PATENT DOCUMENTS 5,528,111 A * 6/1996 Konopka et al. ..... 315/291
5,925,989 A * 7/1999 Blankers ..... 315/307
5,932,974 A 8/1999 Wood ..... 315/119
5,969,484 A * 10/1999 Santi et al. ..... 315/247
6,465,991 B1 * 10/2002 Chang ..... 323/222
2003/0122505 A1 * 7/2003 Huber et al. ..... 315/291
2004/0257000 A1 * 12/2004 Langeslag ..... 315/209 R

OTHER PUBLICATIONS

Tamotsu Ninomiya, et al., "Design of a Nondissipative LC Snubber in a Forward Converter", *Electronics and Communications in Japan*, Part 1, vol. 73, No. 10, 1990, pp. 63-71.
Carlos A. Munoz B., "Study of a New Passive Lossless Turn-off Snubber", CIEP 98, Oct. 12, 1998, pp. 147-152 (see cited Euopean Patent Office Search Report for any further details as to publication).

(Continued)

*Primary Examiner*—Tuyet Thi Vo
(74) *Attorney, Agent, or Firm*—Fitch, Even, Tabin & Flannery

(57) ABSTRACT

An electronic ballast for a lamp (16) having an input circuit (10) having a connection to a voltage supply, an output circuit (14) having a connection for the lamp (16), and a voltage converter apparatus (12), which is arranged between the input and the output circuit (10, 14), the voltage converter apparatus including an input capacitor (C1) and an output capacitor (C2), between which a switching apparatus (T1) and a freewheeling diode (D1) as well as at least one damping element (L2), at least one trapezoidal capacitor (C3) and an inductance (L1) are arranged, the voltage converter apparatus (12) being designed to carry out commutation, in each case a main circuit being defined by the current flow prior to and following commutation, at least one damping element (L2) and at least one trapezoidal capacitor (L2) being connected in series, and such a series circuit being arranged in a secondary circuit.

9 Claims, 3 Drawing Sheets

OTHER PUBLICATIONS

J. Kingston, et al., "Application of a Passive Lossless Snubber to a Tapped Inductor Buck DC/DC Converter", *Power Electronics, Machines and Drives*, Apr. 16-18, 2002, pp. 445-450 (see cited European Patent Office Search Report for any further details as to publication).

C. U-Yaisom, et al., "The Study and Analysis of The Conducted EMI Suppression on Power MOSFET Using Passive Snubber Circuits", Electromagnetic Compatibility—2002 3rd International Symposium, May 21-24, 2002, pp. 561-564 (see cited Euopean Patent Office Search Report for any further details as to publication).

M. Jinno, et al., "An Efficient Active LC Snubber for Multi-Output Converters with Flyback Synchronous Rectifier", Proceedings of IEEE 34th Annual Power Electronics Specialists Conference, Jun. 15-19, 2003, pp. 622-627 (see cited European Patent Office Search Report for any furhter details as to publication).

European Patent Office Search Report (dated Jul. 25, 2005; 4 pages total) for related European Patent Application No. 05008806.

* cited by examiner

-PRIOR ART-

-PRIOR ART-

ELECTRONIC BALLAST WITH VOLTAGE CONVERTER HAVING IMPROVED DAMPING ARRANGEMENT

FIELD OF THE INVENTION

The present invention relates to an electronic ballast for a lamp having an input circuit having a connection to a voltage supply, an output circuit having a connection for the lamp, and a voltage converter apparatus, which is arranged between the input and the output circuit, the voltage converter apparatus comprising an input capacitor and an output capacitor, between which a switching apparatus and a freewheeling diode as well as at least one damping element, at least one trapezoidal capacitor and an inductance are arranged, the voltage converter apparatus being designed to carry out commutation, in each case a main circuit being defined by the current flow prior to and following commutation.

BACKGROUND OF THE INVENTION

Such an apparatus is known from the prior art and is illustrated schematically in FIG. 1, the input circuit having the reference numeral 10, the voltage converter apparatus the reference numeral 12 and the output circuit the reference numeral 14. The lamp is given the reference numeral 16. A more detailed illustration of the circuit arrangement used as the voltage converter apparatus 12 in the prior art can be seen in FIG. 2. This has, on the input side, an input capacitor C1 and, on the output side, an output capacitor C2. This circuit, which is shown here by way of example, is in the form of a step-down converter and has a switching apparatus T1, in this case a transistor, a freewheeling diode D1, a trapezoidal capacitor C3 and an inductance L1. Whilst the switching apparatus T1 and the inductance L1 are arranged in the series branch, the freewheeling diode D1 and the trapezoidal capacitor C3 are each arranged in a parallel branch. A trapezoidal capacitor serves the purpose of setting the switching speed of the switching apparatus. The inductance L1 is conventionally dimensioned as an energy-storage inductor and serves the purpose of maintaining a current flow following commutation.

On switching of the switching apparatus T1, very high current and voltage variation speeds result which can produce radio interference in the range from 20 to 200 MHz in the case of preferred applications of these circuits. In order to adhere to the statutory regulations, a damping element L2, preferably a ferrite, is therefore arranged in series with the switching apparatus T1. Depending on the frequency range, the damping element may also be in the form of an iron sheet or in the form of at least one conductor loop.

In the case of the use of a damping ferrite, in the prior art the latter is preferably threaded onto a transistor leg or is fitted as a separate component. Using such a damping element, the radiofrequency oscillations, which are produced by the switching of the switching element T1, are damped. The disadvantage of this known connection of the damping element consists in the fact that it requires a damping element which needs to be designed such that it represents a resistance which is as low as possible in the case of a direct current and which is as high as possible in the case of a radiofrequency alternating current. The ratio of the resistance given a direct current to the resistance given an alternating current is generally of the order of magnitude of 1:1000. The DC resistance is preferably below 100 mΩ, and the radiofrequency AC resistance should be of the order of magnitude of 100 Ω. In order to achieve these values, the damping element must be relatively large. This has the result that the damping element in the prior art cannot be realized in SMD, but must be mounted as a discrete component by hand on the printed circuit board. The size also has a negative effect on the space which is already limited in an electric ballast.

The present invention is therefore based on the object of developing a generic electronic ballast such that automatic assembly is made possible and a considerable reduction can be achieved in the space taken up by the damping element.

SUMMARY OF THE INVENTION

The invention is based on the knowledge that the damping element can be considerably smaller if it no longer has the main current flowing through it. As a result of the fact that the damping element is cleverly arranged in a secondary circuit, the load current no longer flows through it, such that the DC resistance now only plays a subordinate role. Nevertheless, this may in the process bring about the damping of radiofrequency oscillations which is required of it. Given identical damping, a considerably smaller component can thus be chosen than in the case of the known realization. If the physical size is maintained, considerably improved damping characteristics can be achieved with the electronic ballast according to the invention than in the case of the prior art.

The switching apparatus and the freewheeling diode are preferably in the form of two separate semiconductor components, for example in the form of field-effect transistors.

It is also preferable for the voltage converter apparatus to be designed such that, prior to commutation, the switching apparatus and, following commutation, the freewheeling diode has current flowing through it, or vice versa, and, between these two phases, the at least one series circuit comprising the damping element and the trapezoidal capacitor has current flowing through it.

In preferred embodiments, precisely a series circuit comprising the damping element and the trapezoidal capacitor is provided which is arranged in parallel with the switching apparatus or in parallel with the freewheeling diode. Alternatively, two series circuits each comprising a damping element and a trapezoidal capacitor can be provided, a first such series circuit being arranged in parallel with the switching apparatus and a second such series circuit being arranged in parallel with the freewheeling diode.

As has already been mentioned, the damping element may be in the form of ferrite, in the form of an iron sheet or in the form of at least one conductor loop, depending on the frequency range in which the voltage converter apparatus operates. The at least one damping element is preferably in the form of an SMD component, as a result of which simple, automatic assembly is made possible.

Further advantageous embodiments are described in the subclaims. Exemplary embodiments of the invention will be described in more detail below with reference to the attached drawings.

DETAILED DESCRIPTION OF THE DRAWINGS

Figure 1:
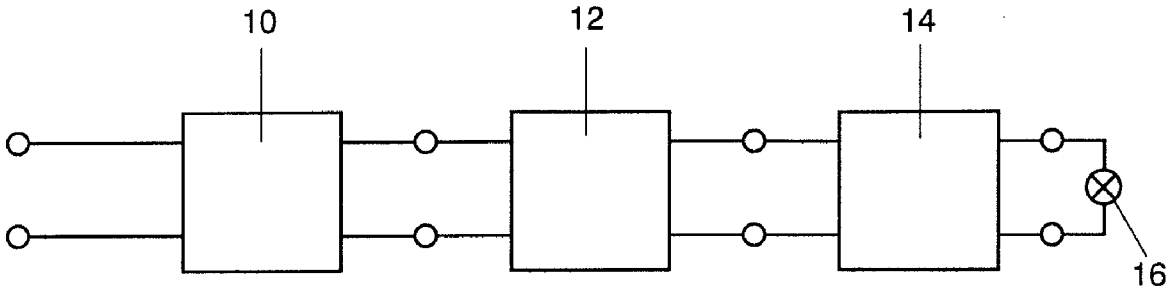
FIG. 1 shows a schematic illustration of the components in an electronic ballast known from the prior art.
Figure 2:
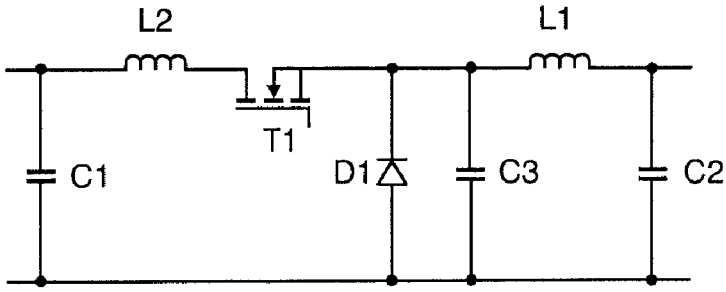
FIG. 2 shows a voltage converter apparatus known from the prior art as is used, by way of example, in the electronic ballast shown in FIG. 1.
Figure 3A:
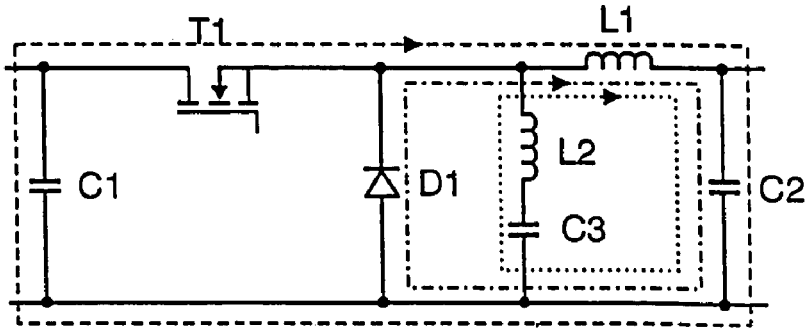
FIG. 3 shows three different embodiments of the voltage converter apparatus in the case of an electronic ballast according to the invention, the respective voltage converter apparatus being in the form of a step-down converter.

FIG. 3 shows three different embodiments of a voltage converter apparatus, as is used in the case of an electronic ballast according to the invention. These three embodiments illustrated in FIG. 3 each serve the purpose of realizing a step-down converter. With reference to the embodiment illustrated in FIG. 3*a*, prior to commutation, a first main circuit is defined which is in this case drawn with dashed lines and which comprises the components input capacitor C1, switching apparatus T1, inductance L1 and output capacitor C2. Following commutation, a second main circuit is defined as a result of the fact that the current flows in the circuit drawn using dash-dotted lines, said circuit comprising the freewheeling diode D1, the inductance L1 and the output capacitor C2. During commutation, the current flows through the series circuit comprising the trapezoidal capacitor C3 and the damping element L2 as well as the output capacitor C2. As regards the current flow prior to and following commutation, as a result of which in each case a main circuit is defined, the series circuit comprising the trapezoidal capacitor C3 and the damping element L2 is arranged in a secondary circuit.

Figure 3B:
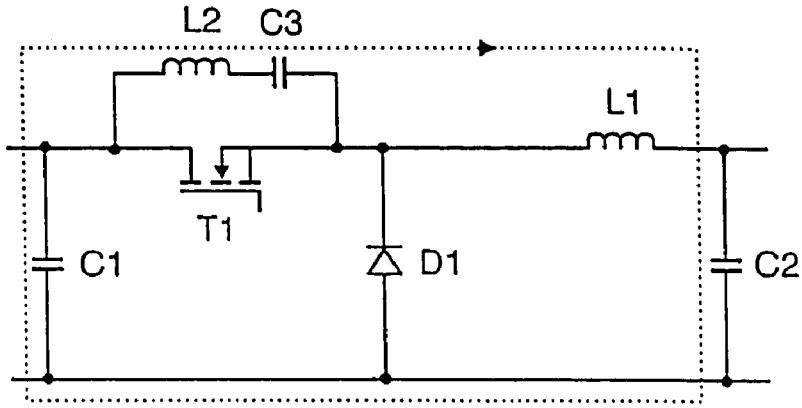
Figure 3C:
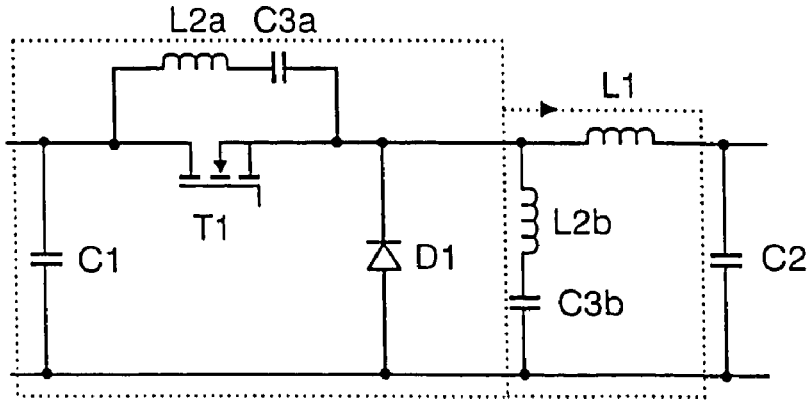

In the embodiment shown in FIGS. 3*b* and 3*c*, the respective main circuit prior to commutation and the respective main circuit following commutation comprise the same elements as have already been described in connection with the embodiment shown in FIG. 3*a*. For reasons of clarity, in the figures and in accordance with the embodiments 3*b* and 3*c*, only the current flow during commutation is therefore drawn with dotted lines. Whilst in the embodiment shown in FIG. 3*b* the series circuit comprising the damping element L2 and the trapezoidal capacitor C3 is arranged in a secondary circuit, which is arranged in parallel with the switching apparatus T1, in the embodiment shown in FIG. 3*c*, in comparison with the embodiment shown in FIG. 3*b*, two series circuits comprising the damping element and the trapezoidal capacitor are provided, namely a first series circuit, which comprises the damping element L2*a* and the trapezoidal capacitor C3*a*, and a second series circuit, which comprises the damping element L2*b* and the trapezoidal capacitor C3*b*. The first series circuit is arranged in parallel with the switching apparatus T1, while the second series circuit is arranged in parallel with the freewheeling diode D1. With reference to the main circuits defined prior to and following commutation, the two series circuits are each located in a secondary circuit.

Figure 4A:
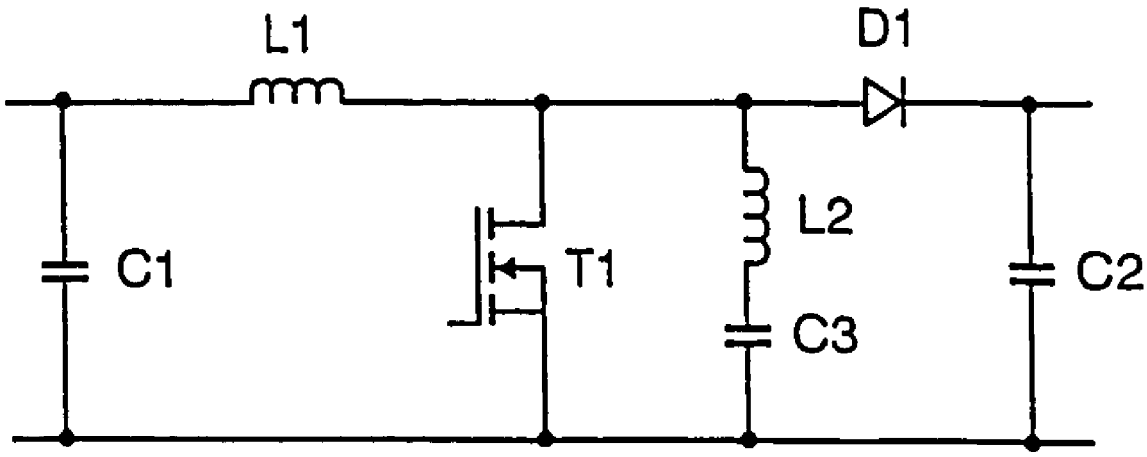
FIG. 4 shows two different embodiments of the voltage converter apparatus in the case of an electronic ballast according to the invention, the respective voltage converter apparatus being in the form of a step-up converter.
Figure 4B:
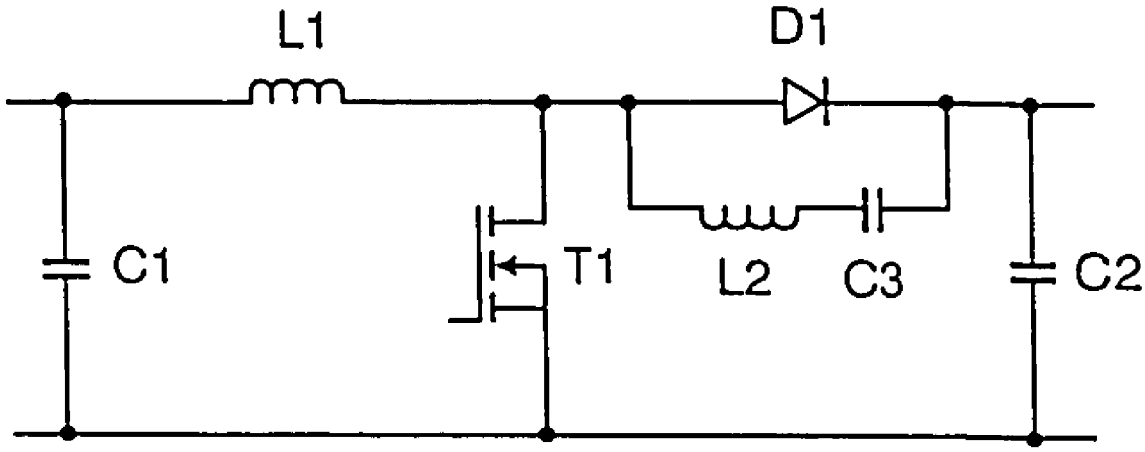

The embodiments, illustrated in FIG. 4*a* and FIG. 4*b*, of a voltage converter apparatus of an electronic ballast according to the invention each realize a step-up converter. In the two embodiments, the main circuit prior to commutation comprises the elements input capacitor C1, inductance L1 and switching apparatus T1; the main circuit following commutation comprises the elements input capacitor C1, inductance L1, freewheeling diode D1 and output capacitor C2. During the commutation phase, the current in the exemplary embodiment shown in FIG. 4*a* flows through the components input capacitor C1, inductance L1, damping element L2 and trapezoidal capacitor C3. In the embodiment shown in FIG. 4*b*, the current flows during the commutation phase through the components input capacitor C1, inductance L1, damping element L2, trapezoidal capacitor C3 and output capacitor C2.

In addition to the embodiments described, a voltage converter apparatus in the case of the ballast according to the invention may also comprise the series arrangement of a step-up converter and a step-down converter, for example the step-up converter being used for power factor correction purposes, and the step-down converter being used for setting the voltage level desired for the output circuit 14.

The invention claimed is:

1. An electronic ballast for a lamp (16) having an input circuit (10) having a connection to a voltage supply, an output circuit (14) having a connection for the lamp (16), and a voltage converter apparatus (12), which is arranged between the input and the output circuit (10, 14), the voltage converter apparatus comprising an input capacitor (C1) and an output capacitor (C2), between which a switching apparatus (T1) and a freewheeling diode (D1) and an inductance (L1) are arranged, the voltage converter apparatus (12) being designed to carry out commutation, in each case a main circuit being defined by the current flow prior to and following commutation, wherein the voltage converter apparatus in characterized by further including a series circuit comprising a damping element (L2) and a trapezoidal capacitor (C3), wherein the series circuit is coupled in parallel with one of:

(i) the switching apparatus (T1); and (ii) the freewheeling diode (D1).

2. The electronic ballast as claimed in claim 1, characterized in that the switching apparatus (T1) and the freewheeling diode (D1) are in the form of two separate semiconductor components.

3. The electronic ballast as claimed in claim 1, characterized in that the voltage converter apparatus (12) is designed such that, prior to commutation, the switching apparatus (T1) and, following commutation, the freewheeling diode (D1) has current flowing through it, or vice versa, and, between these two phases, the series circuit comprising the damping element (L2) and the trapezoidal capacitor (C3) has current flowing through it.

4. The electronic ballast as claimed in claim 1, characterized in that first damping element (L2) is in the form of one of: (i) ferrite; (ii) an iron sheet; and (ii) at least one conductor loop.

5. The electronic ballast as claimed in claim 1, characterized in that the damping element (L2) is in the form of a surface-mount component.

6. An electronic ballast for a lamp (16) having an input circuit (10) having a connection to a voltage supply, an output circuit (14) having a connection for the lamp (16), and a voltage converter apparatus (12), which is arranged between the input and the output circuit (10, 14), the voltage converter apparatus comprising an input capacitor (C1) and an output capacitor (C2), between which a switching apparatus (T1) and a freewheeling diode (D1) and an inductance (L1) are arranged, the voltage converter apparatus (12) being designed to carry out commutation, in each case a main circuit being defined by the current flow prior to and following commutation, wherein the voltage converter apparatus in characterized by further including:

a first series circuit comprising a first damping element (L2*a*) and a first trapezoidal capacitor (C3*a*), the first series circuit being coupled in parallel with the switching apparatus (T1); and a second series circuit comprising a second damping element (L2*b*) and a second trapezoidal capacitor (C3*b*), the second series circuit being coupled in parallel with the freewheeling diode (D1).

7. The electronic ballast as claimed in claim 6, characterized in that the switching apparatus (T1) and the freewheeling diode (D1) are in the form of two separate semiconductor components.

8. The electronic ballast as claimed in claim 6, characterized in that each of the first and second damping elements (L2*a*, L2*b*) is in the form of one of: (i) ferrite; (ii) an iron sheet; and (ii) at least one conductor loop.

9. The electronic ballast as claimed in claim 6, characterized in that each of the first and second damping elements (L2*a*, L2*b*) is in the form of an surface-mount component.

* * * * *